US010697311B2

(12) United States Patent
Nishimura et al.

(10) Patent No.: US 10,697,311 B2
(45) Date of Patent: Jun. 30, 2020

(54) TURBINE BLADE AND GAS TURBINE

(71) Applicant: MITSUBISHI HEAVY INDUSTRIES, LTD., Tokyo (JP)

(72) Inventors: Kazuya Nishimura, Tokyo (JP); Daigo Fujimura, Tokyo (JP); Eisaku Ito, Tokyo (JP); Koichi Ishizaka, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 475 days.

(21) Appl. No.: 15/514,649

(22) PCT Filed: Oct. 20, 2015

(86) PCT No.: PCT/JP2015/079555
§ 371 (c)(1),
(2) Date: Mar. 27, 2017

(87) PCT Pub. No.: WO2016/080136
PCT Pub. Date: May 26, 2016

(65) Prior Publication Data

US 2017/0226866 A1 Aug. 10, 2017

(30) Foreign Application Priority Data

Nov. 20, 2014 (JP) ..... 2014-235422

(51) Int. Cl.
*F01D 5/20* (2006.01)
*F01D 11/12* (2006.01)

(52) U.S. Cl.
CPC ..... *F01D 5/20* (2013.01); *F01D 11/12* (2013.01); *F05D 2220/32* (2013.01); *F05D 2240/307* (2013.01)

(58) Field of Classification Search
CPC . F01D 5/20; F01D 5/141; F01D 5/147; F01D 11/08; F01D 11/12; F05D 2240/307
See application file for complete search history.

(56) References Cited

U.S. PATENT DOCUMENTS 3,899,267 A * 8/1975 Dennis ..... B23P 15/04 416/92
4,589,823 A * 5/1986 Koffel ..... F01D 5/20 415/173.4

(Continued)

FOREIGN PATENT DOCUMENTS

EP 2 309 097 4/2011
FR 370215 2/1907

(Continued)

OTHER PUBLICATIONS

Office Action dated Mar. 14, 2019 in corresponding German Application No. 112015003538.9, with English translation.

(Continued)

*Primary Examiner* — Kenneth J Hansen
*Assistant Examiner* — Maranatha Boardman
(74) *Attorney, Agent, or Firm* — Wenderoth, Lind & Ponack, L.L.P.

(57) ABSTRACT

A turbine rotor blade includes an airfoil portion having an airfoil defined by a pressure surface and a suction surface; and a squealer rib on a tip surface of the turbine rotor blade, the squealer rib extending from a leading-edge side (toward a trailing-edge side. The squealer rib has a ridge extending in an extending direction of the squealer rib. The turbine rotor blade is configured to provide a clearance between the tip surface of the turbine rotor blade and an inner wall surface of a casing of a turbine such that the inner wall surface of the casing of the turbine faces the tip surface of the turbine rotor blade and the clearance has a local mini- (Continued)

mum value on the ridge. The clearance is greater than the local minimum value at both sides of the ridge in a width direction of the squealer rib.

12 Claims, 9 Drawing Sheets

(56) References Cited

U.S. PATENT DOCUMENTS

| | | | | |
|---|---|---|---|---|
| 4,957,411 | A * | 9/1990 | Girault | F01D 5/20 415/173.4 |
| 6,059,530 | A | 5/2000 | Lee | |
| 6,086,328 | A * | 7/2000 | Lee | F01D 5/18 415/115 |
| 6,190,129 | B1 * | 2/2001 | Mayer | F01D 5/187 416/235 |
| 6,602,052 | B2 * | 8/2003 | Liang | F01D 5/18 416/224 |
| 6,672,829 | B1 * | 1/2004 | Cherry | F01D 5/141 415/115 |
| 6,971,851 | B2 * | 12/2005 | Liang | F01D 5/08 416/1 |
| 7,473,073 | B1 * | 1/2009 | Liang | F01D 5/20 415/173.5 |
| 7,494,319 | B1 | 2/2009 | Liang | |
| 8,684,691 | B2 | 4/2014 | Lee et al. | |
| 9,771,870 | B2 * | 9/2017 | Dierksmeier | F01D 5/085 |
| 2004/0096328 | A1 | 5/2004 | Soechting et al. | |
| 2009/0148305 | A1 | 6/2009 | Riahi et al. | |
| 2011/0135496 | A1 | 6/2011 | Botrel et al. | |
| 2012/0282108 | A1 | 11/2012 | Lee et al. | |
| 2014/0047842 | A1 | 2/2014 | Chlus et al. | |
| 2014/0178207 | A1 * | 6/2014 | He | F01D 5/20 416/96 R |
| 2015/0337670 | A1 * | 11/2015 | Merriman | F01D 5/20 416/241 R |
| 2016/0362987 | A1 * | 12/2016 | Hansen | F01D 5/20 |

FOREIGN PATENT DOCUMENTS

| | | |
|---|---|---|
| GB | 1107024 | 3/1968 |
| JP | 60-256502 | 12/1985 |
| JP | 62-186004 | 8/1987 |
| JP | 11-324604 | 11/1999 |
| JP | 2000-297603 | 10/2000 |
| JP | 2004-169694 | 6/2004 |
| JP | 2006-511757 | 4/2006 |
| JP | 2011-513638 | 4/2011 |
| JP | 2011-163123 | 8/2011 |
| WO | 2014/096838 | 6/2014 |
| WO | 2014/099814 | 6/2014 |

OTHER PUBLICATIONS

Office Action dated Feb. 23, 2018 in Korean Application No. 10-2017-7004086, with English Translation.

Office Action dated Jul. 2, 2018 in corresponding Korean Application No. 10-2017-7004086, with English translation.

International Preliminary Report on Patentability dated Jun. 1, 2017 in corresponding International Application No. PCT/JP2015/079555 (with English translation).

International Search Report dated Jan. 26, 2016 in corresponding International Application No. PCT/JP2015/079555.

* cited by examiner

TURBINE BLADE AND GAS TURBINE

TECHNICAL FIELD

The present disclosure relates to a turbine rotor blade and a gas turbine.

BACKGROUND ART

Generally, a gas turbine includes a compressor, a combustor, and a turbine, and is configured to combust air compressed by the compressor and fuel in the combustor to produce combustion gas having a high temperature and a high pressure, and to drive a turbine with the combustion gas to obtain power. A turbine includes blade rows disposed inside a casing, the blade rows including a plurality of turbine stator vanes and a plurality of turbine rotor blades arranged alternately. Combustion gas is taken into the casing to drive the turbine rotor blades to rotate, thereby rotating a rotor coupled to the turbine rotor blades.

In such a turbine, normally, clearance is provided between the casing and tip ends of the turbine rotor blades so as not to cause rubbing due to a difference in thermal expansion between the casing and the turbine rotor blades.

However, during operation of a gas turbine, a part of a main flow of combustion gas may leak out through the clearance from a pressure side to a suction side of turbine rotor blades without performing work, due to a pressure difference between the pressure side and the suction side. Besides failing to perform work on the blade rows of the turbine, a leakage flow through the clearance rolls up at the outlet side of the clearance to form a longitudinal vortex, and mixes with the main flow, which may lead to generation of pressure loss. Loss due to a leakage flow through the clearance is one of the main factors that deteriorate the turbine efficiency.

In this context, to reduce loss due to a leakage flow through the clearance, known is a configuration provided with a squealer rib formed on a tip end of a turbine rotor blade, as disclosed in U.S. Pat. No. 8,684,691B and JP2011-163123A. A squealer rib is a fence-shaped projection formed along an outer periphery of a tip surface of a turbine rotor blade, also called as a squealer. With a squealer rib provided on a tip end of a turbine rotor blade, a flow-path resistance in the clearance increases, and the contraction-flow effect reduces the amount of leakage flow through the clearance. U.S. Pat. No. 8,684,691B and JP2011-163123A also disclose a squealer rib with an inclined side face.

Problems to be Solved

However, although providing a squealer rib makes it possible to achieve the contraction-flow effect to some extent as described in U.S. Pat. No. 8,684,691B and JP2011-163123A, the effect may not be always effectively achieved, because a flow of a fluid flowing along the inclined side face of the squealer rib partially adheres to an end surface of the squealer rib and flows along the end surface, when the flow passes through a clearance between the inner wall surface of the casing and the end surface of the squealer rib.

SUMMARY

In view of the above issues, an object of at least one embodiment of the present invention is to provide a turbine rotor blade and a gas turbine, whereby it is possible to reduce the amount of leakage flow leaking through a clearance between turbine rotor blades and a casing, and to suppress loss due to the leakage flow effectively.

Solution to the Problems (1) A turbine rotor blade for a turbine, according to at least one embodiment of the present invention, comprises: an airfoil portion having an airfoil formed by a pressure surface and a suction surface; and at least one squealer rib disposed on a tip surface of the turbine rotor blade so as to extend from a leading-edge side toward a trailing-edge side. At least one of the at least one squealer rib has a ridge extending in an extending direction of the squealer rib. A clearance between the tip surface and an inner wall surface of a casing of the turbine, the inner wall surface facing the tip surface, has a local minimum value on the ridge. The clearance is greater than the local minimum value at both sides of the ridge in a width direction of the squealer rib.

According to the above configuration (1), the squealer rib is configured such that the clearance between the inner wall surface of the casing of the turbine and the tip surface of the turbine rotor blade reaches its local minimum on the ridge extending in the extending direction of the squealer rib. Accordingly, when a fluid flows through the clearance between the inner wall surface of the casing and the ridge of the squealer rib, the contraction-flow effect reduces the effective flow-path area, which makes it possible to reduce the amount of leakage flow and pressure loss due to the leakage flow. Thus, it is possible to reduce loss due to the leakage flow (clearance loss).

Furthermore, the squealer rib is configured such that the clearance between the inner wall surface of the casing and the tip surface of the turbine rotor blade is greater than the local minimum value on both sides of the ridge. That is, the squealer rib has no flat surface forming the clearance of the local minimum between the tip surface of the turbine rotor blade and the inner wall surface of the casing, at both sides of the ridge of the squealer rib. Accordingly, there is no flat surface forming the clearance of the local minimum at the downstream side of the ridge, and thereby it is possible to suppress re-adhesion of a flow of a fluid to the squealer rib when the flow of the fluid separates from the squealer rib and passes through the ridge. Thus, it is possible to suppress a decrease in the contraction-flow effect of the squealer rib due to re-adhesion of a flow, and thus to reduce loss due to the leakage flow (clearance loss) even further.

(2) In some embodiments, in the above configuration (1), at least one of the at least one squealer rib has a narrowing surface disposed between a pressure-side edge on a pressure side and the ridge disposed closer to a suction side than the pressure-side edge, the narrowing surface monotonically reducing the clearance from the pressure-side edge toward the ridge.

Accordingly, with the narrowing surface monotonically reducing the clearance from the pressure-side edge toward the ridge, it is possible to form a fluid flow flowing outward in the radial direction along the narrowing surface, and to enhance the contraction-flow effect. Herein, outward in the radial direction refers to a direction directed from inside toward outside in the radial direction of the turbine.

(3) In some embodiments, in the above configuration (1) or (2), at least one of the at least one squealer rib has a receding surface disposed between a suction-side edge on a suction side and the ridge disposed closer to a pressure side than the suction-side edge, the receding surface monotonically increasing the clearance from the ridge toward the suction-side edge.

In this case, the receding surface monotonically increasing the clearance between the tip surface of the turbine rotor blade and the inner wall surface of the casing toward the suction-side edge extends from the ridge to the suction-side edge, and thereby re-adhesion of a fluid flow separated at the ridge to the squealer rib (receding surface) is even less likely to occur. Thus, it is possible to suppress effectively a decrease in the contraction-flow effect of the squealer rib due to re-adhesion of a flow.

(4) In some embodiments, in any one of the above configurations (1) to (3), the at least one squealer rib comprises: a first squealer rib disposed on a pressure side; and a second squealer rib disposed on a suction side at a distance from the first squealer rib. At least one of the first squealer rib or the second squealer rib has the ridge at which the clearance reaches the local minimum value.

Since the squealer ribs (the first squealer rib and the second squealer rib) are disposed respectively on the sides of the pressure surface and the suction surface, the effect to reduce the amount of leakage flow improves. In addition, since at least one of the squealer ribs has the ridge described in the above (1) to (3), it is possible to achieve a remarkable effect to reduce the amount of leakage flow also for the reason described in the above (1).

(5) In an embodiment, in the above configuration (4), each of the first squealer rib and the second squealer rib has a narrowing surface disposed between a pressure-side edge on a pressure side and the ridge disposed closer to a suction side than the pressure-side edge, the narrowing surface monotonically reducing the clearance from the pressure-side edge toward the ridge.

According to the above embodiment, the first contraction-flow effect is achieved by the first squealer rib. The first contraction flow along the narrowing surface of the first squealer rib diffuses at the downstream side of the ridge of the first squealer rib, but at least a part of the diffused flow is captured by the narrowing surface of the second squealer rib, and thereby the second contraction-flow effect is achieved by the narrowing surface of the second squealer rib. Accordingly, it is possible to reduce the amount of leakage flow effectively with the first squealer rib and the second squealer rib.

(6) In an embodiment, in the above configuration (5), the narrowing surface of the second squealer rib is disposed over a wider range in a blade height direction of the turbine rotor blade than the narrowing surface of the first squealer rib.

Accordingly, the flow diffused at the downstream side of the ridge of the first squealer rib can be captured in a wider range at the narrowing surface of the second squealer rib, which makes it possible to enhance the contraction-flow effect achieved by the second squealer rib.

(7) In an embodiment, in the above configuration (6), the narrowing surface of the first squealer rib and the narrowing surface of the second squealer rib are inclined from the inner wall surface of the casing. The narrowing surface of the second squealer rib has a greater inclination angle than the narrowing surface of the first squealer rib with respect to the inner wall surface of the casing.

To expand a range of capture, in the blade height direction, of a flow diffused at the downstream side of the ridge of the first squealer rib, there are two approaches: to expand the narrowing surface of the second squealer rib in the width direction of the squealer rib; or to increase the inclination angle of the narrowing surface of the second squealer rib with respect to the inner wall surface of the casing. According to the latter approach, as compared to the former one, it is possible to enhance the velocity component directed outward in the radial direction by capturing a flow with the narrowing surface of the second squealer rib and changing the direction of the flow with the narrowing surface of the second squealer rib.

In this regard, with the above configuration (7), the inclination angle of the narrowing surface of the second squealer rib with respect to the inner wall surface of the casing is greater than the inclination angle of the narrowing surface of the first squealer rib with respect to the inner wall surface of the casing. Accordingly, as compared to a case in which the narrowing surface of the first squealer rib and the narrowing surface of the second squealer rib are inclined from the inner wall surface of the casing at the same angle, the fluid flowing along the narrowing surface of the second squealer rib has a stronger velocity component directed outward in the radial direction, which makes it possible to enhance the contraction-flow effect achieved by the second squealer rib.

(8) In another embodiment, in the above configuration (5), the narrowing surface of the first squealer rib and the narrowing surface of the second squealer rib are inclined from the inner wall surface of the casing. The narrowing surface of the second squealer rib is on the same plane as the narrowing surface of the first squealer rib.

Accordingly, it is possible to send a flow having an enhanced velocity component directed outward in the radial direction at the narrowing surface of the first squealer rib to the narrowing surface of the second squealer rib disposed on the same plane as the narrowing surface of the first squealer rib, which makes it possible to improve the contraction-flow effect at the second squealer rib.

(9) In another embodiment, in the above configuration (4), the first squealer rib has a receding surface disposed between a suction-side edge on a suction side and the ridge disposed closer to a pressure side than the suction-side edge, the receding surface monotonically increasing the clearance from the ridge toward the suction-side edge. The second squealer rib has a narrowing surface disposed between a pressure-side edge on a pressure side and the ridge disposed closer to the suction side than the pressure-side edge, the narrowing surface monotonically reducing the clearance from the pressure-side edge toward the ridge.

According to the above embodiment, it is possible to suppress re-adhesion of a fluid to the first squealer rib at the downstream side of the ridge on the first squealer rib, and thus to enhance the contraction-flow effect achieved by the first squealer rib. Furthermore, a flow having passed through the first squealer rib diffuses at the downstream side of the ridge, but at least a part of the diffused flow is captured by the narrowing surface of the second squealer rib, and thereby the second contraction-flow effect is achieved by the narrowing surface of the second squealer rib.

(10) In an embodiment, in the above configuration (9), the narrowing surface of the second squealer rib is disposed over a wider range in a blade height direction of the turbine rotor blade than the receding surface of the first squealer rib.

Accordingly, the flow diffused at the downstream side of the ridge of the first squealer rib can be captured in a wider range at the narrowing surface of the second squealer rib, which makes it possible to enhance the contraction-flow effect achieved by the second squealer rib.

(11) In an embodiment, in the above configuration (10), each of the receding surface of the first squealer rib and the narrowing surface of the second squealer rib is inclined from the inner wall surface of the casing. The narrowing surface of the second squealer rib has an inclination angle of a greater absolute value than the receding surface of the first squealer rib with respect to the inner wall surface of the casing.

Accordingly, it is possible to enhance the velocity component, directed outward in the radial direction, of the fluid flowing along the narrowing surface of the second squealer rib, and to improve the contraction-flow effect achieved by the second squealer rib.

(12) In some embodiments, in any one of the above configurations (1) to (11), at least one of the squealer rib has a chamfered edge portion including the ridge.

Accordingly, it is possible to reduce oxidation thinning of the edge portion, and to improve reliability of the turbine rotor blade.

(13) A turbine rotor blade for a turbine (having a configuration other than one described in the above (1)) according to at least one embodiment of the present invention comprises: an airfoil portion having an airfoil formed by a pressure surface and a suction surface; and at least one squealer rib disposed on an edge portion on a suction side or a pressure side on a tip surface of the turbine rotor blade so as to extend from a leading-edge side toward a trailing-edge side. A region of the tip surface other than the squealer rib is inclined from an inner wall surface of a casing of the turbine, the inner wall surface facing the tip surface. A clearance between the tip surface and the inner wall surface of the casing in the region increases with a distance from the squealer rib with respect to a width direction of the squealer rib.

With the above configuration (13), a region of the tip surface of the turbine rotor blade other than the squealer rib is inclined from the inner wall surface of the casing, and a clearance between the tip surface of the turbine rotor blade and the inner wall surface of the casing increases with a distance from the squealer rib.

Accordingly, in a case where the squealer rib is disposed on an edge portion on the suction side of the tip surface of the turbine rotor blade, it is possible to form a fluid flow directed outward in the radial direction with the inclined surface (region other than the squealer rib on the tip surface of the turbine rotor blade) disposed closer to the pressure side than the squealer rib, and thus to enhance the contraction-flow effect at the squealer rib. Thus, it is possible to reduce the amount of leakage flow by the high contraction-flow effect achieved by the squealer rib, and to reduce loss due to the leakage flow (clearance loss).

On the other hand, if the squealer rib is disposed on an end portion on the pressure side of the tip surface of the turbine rotor blade, it is possible to suppress re-adhesion of a flow toward the inclined surface (region other than the squealer rib on the tip surface of the turbine rotor blade) disposed closer to the suction side than the squealer rib, at the downstream side of the squealer rib. Thus, it is possible to suppress a decrease in the contraction-flow effect of the squealer rib due to re-adhesion of a flow, and to reduce loss due to the leakage flow (clearance loss).

(14) In some embodiments, in any one of the above configurations (1) to (13), the turbine is a gas turbine.

With the turbine rotor blade having the above configuration (14), as described in the above (1) or (13), it is possible to reduce loss (clearance loss) due to the leakage flow through the clearance between the tip surface of the turbine rotor blade and the inner wall surface of the casing, and thus it is possible to improve efficiency of the gas turbine to which the turbine rotor blade is applied.

(15) A gas turbine according to at least one embodiment of the present invention comprises: a turbine including a rotor shaft having the turbine rotor blade according to the above (14) mounted to the rotor shaft in a circumferential direction, and a turbine casing housing the rotor shaft; a combustor formed inside the turbine casing, for supplying combustion gas to a combustion gas passage accommodating the turbine rotor blade; and a compressor configured to be driven by the turbine and to produce compressed air to be supplied to the combustor.

With the above configuration (15), the gas turbine is provided with the turbine rotor blade described in the above (14), and thus it is possible to improve the efficiency of the gas turbine.

Advantageous Effects

According to at least one embodiment of the present invention, it is possible to maintain a high contraction-flow effect achieved by a squealer rib disposed on a turbine rotor blade. Thus, it is possible to reduce the amount of leakage flow at the clearance between the tip surface of the turbine rotor blade and the inner wall surface of the casing, and to reduce loss (clearance loss) due to the leakage flow.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not intended to limit the scope of the present invention.

Figure 1:
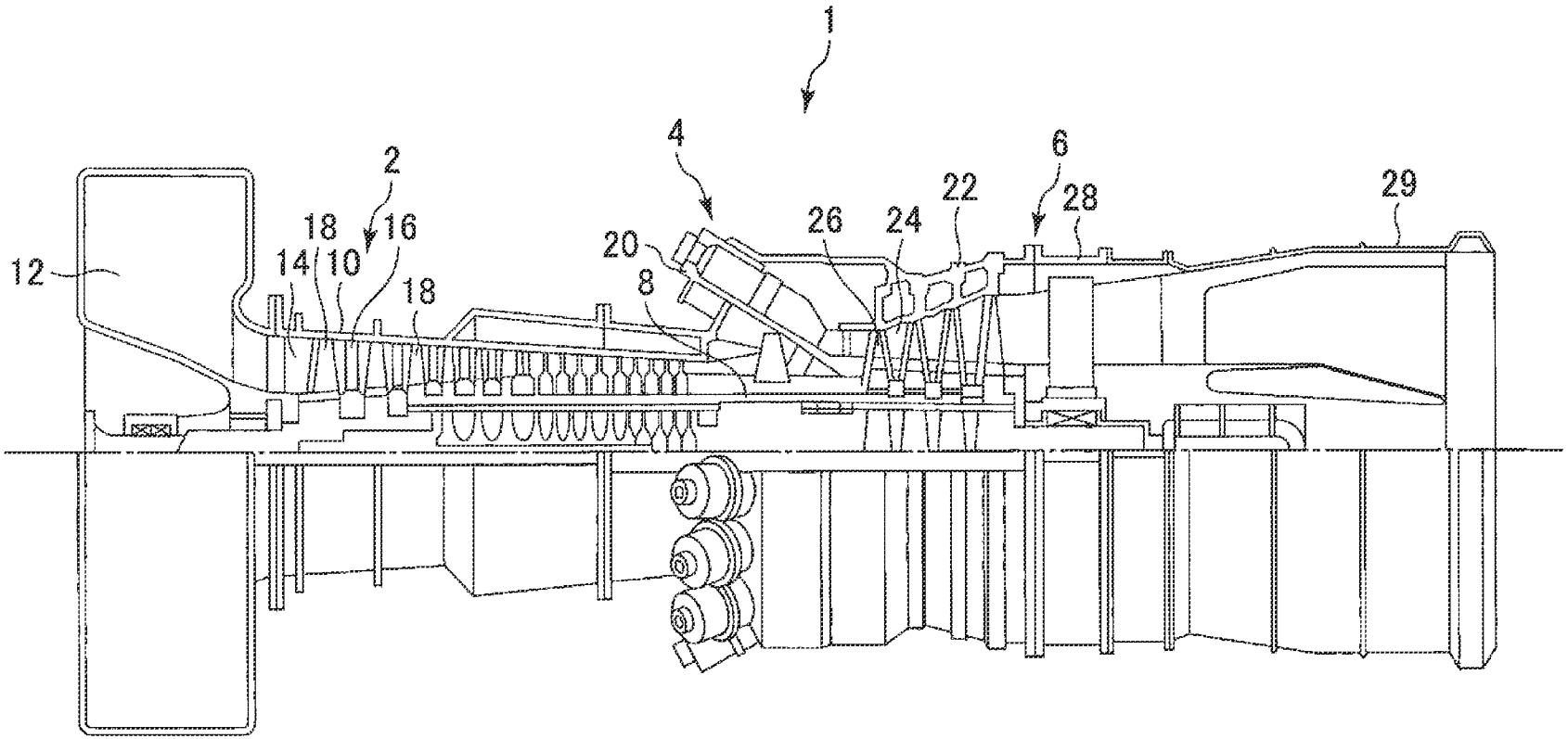
FIG. 1 is a schematic configuration diagram of a gas turbine according to some embodiments.

First, with reference to FIG. 1, a gas turbine 1 according to the present embodiment will be described. FIG. 1 is a schematic configuration diagram of a gas turbine 1 according to some embodiments.

As depicted in FIG. 1, the gas turbine 1 according to some embodiments includes a compressor 2 for producing compressed air, a combustor 4 for producing combustion gas from the compressed air and fuel, and a turbine 6 configured to be driven to rotate by combustion gas to rotate. In a case where the gas turbine 1 is for power generation, a generator (not illustrated) is connected to the turbine 6, so that rotational energy of the turbine 6 generates electric power.

The configuration example of each component in the gas turbine 1 will be described specifically.

The compressor 2 includes a compressor casing 10, an air inlet 12 for sucking in air, disposed on an inlet side of the compressor casing 10, a rotor shaft 8 disposed so as to penetrate through both of the compressor casing 10 and a turbine casing 22 described below, and a variety of blades disposed in the compressor casing 10. The variety of blades includes an inlet guide vane 14 disposed adjacent to the air inlet 12, a plurality of compressor stator vanes 16 fixed to the compressor casing 10, and a plurality of compressor rotor blades 18 implanted on the rotor shaft 8 so as to be arranged alternately with the compressor stator vanes 16. The compressor 2 may include other constituent elements not illustrated in the drawings, such as an extraction chamber. In the above compressor 2, the air sucked in from the air inlet 12 flows through the plurality of compressor stator vanes 16 and the plurality of compressor rotor blades 18 to be compressed, and thereby compressed air is produced. The compressed air is sent to the combustor 4 of the latter stage from the compressor 2.

The combustor 4 is disposed in a casing (combustor casing) 20. As depicted in FIG. 1, a plurality of combustors 4 may be disposed in annular shape centered at the rotor shaft 8 inside the casing 20. The combustor 4 is supplied with fuel and the compressed air produced by the compressor 2, and combusts the fuel to produce combustion gas having a high pressure and a high temperature that serves as a working fluid of the turbine 6. The combustion gas is sent to the turbine 6 of the latter stage from the combustor 4.

The turbine 6 includes a turbine casing 22 and a variety of turbine blades disposed inside the turbine casing 22. The variety of turbine blades includes a plurality of turbine stator vanes 24 fixed to the turbine casing 22 and a plurality of turbine rotor blades 26 implanted on the rotor shaft 8 so as to be arranged alternately with the turbine stator vanes 24. The turbine rotor blades 26 are configured to generate a rotational driving force from combustion gas having a high temperature and a high pressure flowing through the turbine casing 22 with the turbine stator vanes 24. The rotational driving force is transmitted to the rotor shaft 8. A specific configuration example of the turbine rotor blades 26 will be described later. The turbine 6 may include other constituent elements, such as outlet guide vanes and the like. In the turbine 6 having the above configuration, the rotor shaft 8 is driven to rotate as the combustion gas passes through the plurality of turbine stator vanes 24 and the plurality of turbine rotor blades 26. In this way, the generator connected to the rotor shaft 8 is driven.

An exhaust chamber 29 is connected to the downstream side of the turbine casing 22 via an exhaust casing 28. The combustion gas having driven the turbine 6 passes through the exhaust casing 28 and the exhaust chamber 29 before being discharged outside.

Figure 2:
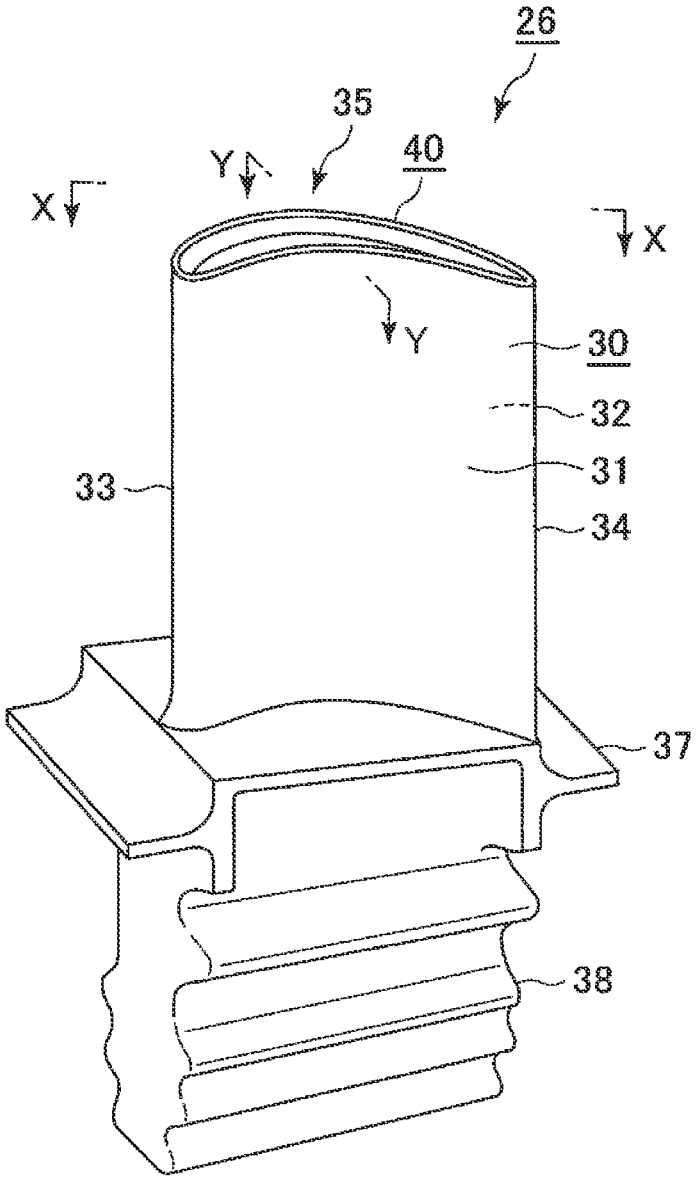
FIG. 2 is a perspective view of a turbine rotor blade according to some embodiments.
Figure 3:
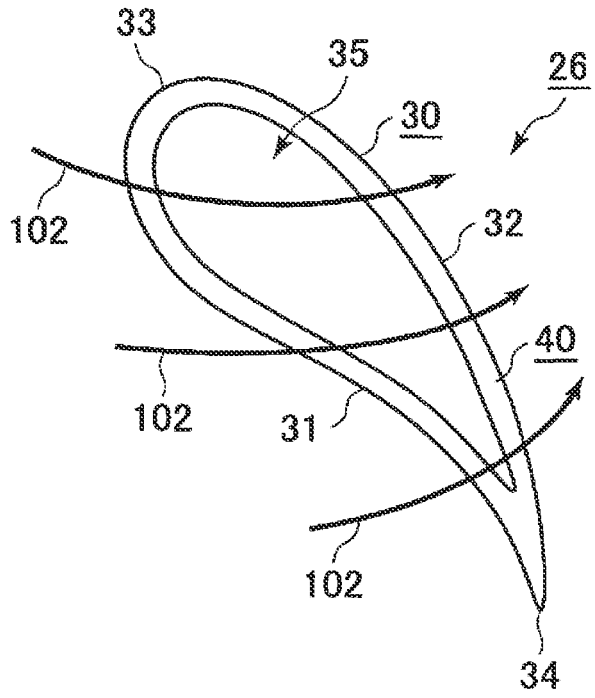
FIG. 3 is a view of the turbine rotor blade depicted in FIG. 2, as seen from the direction of arrows X.

With reference to FIGS. 2 and 3, a configuration example of the turbine rotor blades 26 will be described. FIG. 2 is a perspective view of a turbine rotor blade 26 according to some embodiments. FIG. 3 is a view of the turbine rotor blade 26 depicted in FIG. 2, as seen from the direction of arrows X.

FIG. 2 illustrates one of a plurality of turbine rotor blades 26 according to an embodiment provided for the turbine 6 (see FIG. 1), disposed at regular intervals in the circumferential direction along the outer peripheral surface of the rotor shaft 8 (see FIG. 1). The turbine rotor blade 26 is disposed so as to extend outward in the radial direction from the side of the rotor shaft 8. In the present embodiment, outward in the radial direction refers to a direction from inside (the side of the rotor shaft 8) toward outside (the side of the casing 22) in the radial direction of the turbine 6, centered at the rotational axis of the rotor shaft 8. In the present embodiment, the turbine rotor blade 26 is a free-standing blade that does not have a shroud. The turbine rotor blade 26 is erected on a platform 37. The platform 37 has a root portion (on the opposite side from the turbine rotor blade 26 across the platform 37) having an engagement portion 38 to be fixed to the rotor shaft 8.

In an embodiment, the turbine rotor blade 26 includes an airfoil portion 30 having an airfoil, and a squealer rib 40 disposed on a tip end of the turbine rotor blade 26. Herein, a tip end is an end portion of the turbine rotor blade 26, disposed on the outer side in the radial direction.

The airfoil portion 30 includes: a pressure surface 31 along which combustion gas having a relatively high pressure flows; a suction surface 32 along which combustion gas having a lower pressure than that along the pressure surface 31 flows; a leading edge 33; and a trailing edge 34. In the direction of a flow of combustion gas that mainly performs work on the turbine rotor blade 26 (hereinafter, referred to as a main flow), the leading edge 33 is an upstream end portion of the airfoil portion 30, and the trailing edge 34 is a downstream end portion of the airfoil portion 30.

A tip surface 35 is formed on an end portion of the turbine rotor blade 26 on the outer side in the radial direction, the tip surface 35 facing the inner wall surface of the casing 22. The tip surface 35 of the turbine rotor blade 26 includes a portion formed by the airfoil portion 30 and a portion formed by the squealer rib 40. Further, the tip surface 35 includes a region facing the inner wall surface 23 of the casing 22, either in parallel or at an angle.

With regard to the squealer rib 40, at least one squealer rib 40 is disposed on the turbine rotor blade 26 so as to extend from the leading edge 33 toward the trailing edge 34, on the tip surface 35 of the turbine rotor blade 26. Specifically, the squealer rib 40 is a fence-shaped protrusion extending outward in the radial direction, on the tip end of the turbine rotor blade 26. In the example depicted in FIG. 2, one squealer rib 40 is disposed continuously over the entire periphery of the airfoil portion 30 so as to extend along the outer periphery of the airfoil portion 30. Nevertheless, the configuration of the squealer rib 40 is not limited to one being disposed over the entire periphery of the airfoil portion 30. The squealer rib 40 may be disposed on a portion not along the outer periphery of the airfoil portion 30. Alternatively, one or two or more squealer ribs 40 may be disposed partially along the outer periphery of the airfoil portion 30. For instance, one squealer rib 40 may be provided along each of the pressure surface 31 and the suction surface 32, or only one squealer rib 40 may be disposed on either one of the pressure surface 31 or the suction surface 32. Alternatively, one squealer rib 40 may be disposed continuously over the entire periphery of the airfoil portion 30, with another squealer rib 40 further being provided across the center of the airfoil portion 30.

Furthermore, the side face of the squealer rib 40 may extend in the axial direction of the airfoil portion 30. Specifically, in a case where the squealer rib 40 is disposed along the pressure surface 31 and the suction surface 32 of the airfoil portion 30, side faces on the outer periphery of the squealer rib 40 are formed to be flush with the pressure surface 31 and the suction surface 32.

At the tip end of the turbine rotor blade 26 having the above configuration, normally, a leakage flow 102 is generated (see FIG. 2), which is a part of a main flow leaking out from the side of the pressure surface 31 toward the side of the suction surface 32 through a clearance (gap) 100 between the inner wall surface 23 of the casing 22 and the tip surface 35 of the turbine rotor blade 26, due to a pressure difference between the pressure surface 31 and the suction surface 32. Providing the squealer rib 40 having the above configuration reduces the clearance 100 between the tip surface 35 of the turbine rotor blade 26 and the inner wall surface 23 of the casing 22, thus increasing a flow-path resistance in the region of the clearance 100, and the contraction-flow effect reduces the amount of leakage flow through the clearance 100.

In some embodiments, the turbine rotor blade 26 further includes a configuration depicted in any one of FIGS. 4 to 9, to ensure that a high contraction-flow effect is achieved by the squealer rib 40. FIGS. 4A to 4C, FIG. 6, FIGS. 7A to 7C, FIG. 8, and FIGS. 9A and 9B are each a cross-sectional view of a tip end of the turbine rotor blade 26 and its peripheral structure according to an embodiment. Each cross section corresponds to a cross section of the turbine rotor blade 26 depicted in FIG. 2, taken along line Y-Y.

In FIGS. 4 to 9 that illustrate respective embodiments, the same component is indicated by the same reference numeral. Nevertheless, if the same component has partially different structures between different embodiments, the difference will be described later in detail for each embodiment.

As a common configuration shared by the respective embodiments shown in FIGS. 4 to 8, the squealer rib 40 of the above described turbine rotor blade 26 includes a first squealer rib 42 disposed on the side of the pressure surface 31, and a second squealer rib 44 disposed on the side of the suction surface 32 at a distance from the first squealer rib 42. The embodiment depicted in FIG. 9 will be described later in detail.

Hereinafter, when describing at least one of the first squealer rib 42 or the second squealer rib 44, it will be referred to as a squealer rib 40 (42, 44). The squealer rib 40 (42, 44) has a ridge 43, 45 extending continuously in the extending direction of the squealer rib 40 (42, 44). At the ridge 43, 45, the clearance 100 between the inner wall surface 23 of the casing 22 and the tip surface 35 of the turbine rotor blade 26 reaches its local minimum value, and is greater than the local minimum value at both sides of the ridge 43, 45 in the width direction of the squealer rib 40 (42, 44) (hereinafter, simply referred to as the width direction). It should be noted that the squealer rib 40 (42, 44) may not have the above configuration if, for instance, the squealer rib 40 (42, 44) does not have the ridge 43, 45 like the second squealer rib 44 depicted in FIG. 4A or the first squealer rib 42 depicted in FIGS. 4B and 4C.

The turbine rotor blade 26 according to the present embodiment also includes a configuration in which a side face on the outer periphery of the squealer rib 42, 44 is flush with the pressure surface 31 or the suction surface 32, and the ridge 43, 45 is disposed on the side face on the outer periphery of the squealer rib 42, 44, in case of which no clearance 100 exists on the outer peripheral side of the ridge 43, 45 in the width direction. For instance, in FIG. 4B, the side face on the outer periphery of the second squealer rib 44 is flush with the suction surface 32, and the ridge 45 of the second squealer rib 44 is disposed on the side face on the outer peripheral side. In this case, there is no clearance 100 on the outer peripheral side (right side in the drawing) of the ridge 45, but the turbine rotor blade 26 of the present embodiment also includes the configuration of this case.

According to the above embodiment, the squealer rib 40 (42, 44) is configured such that the clearance 100 between the inner wall surface 23 of the casing 22 and the tip surface 35 of the turbine rotor blade 26 reaches its local minimum value on the ridge 43, 45 extending in the extending direction of the squealer rib 40 (42, 44). Accordingly, when a fluid flows through the clearance 100 between the inner wall surface 23 of the casing 22 and the ridge 43, 45 of the squealer rib 40 (42, 44), the contraction-flow effect reduces the effective flow-path area, which makes it possible to reduce the amount of leakage flow and pressure loss due to the leakage flow 102 (see FIG. 3). Thus, it is possible to reduce loss due to the leakage flow 102 (clearance loss).

Furthermore, the squealer rib 40 (42, 44) is configured such that the clearance 100 between the inner wall surface 23 of the casing 22 and the tip surface 35 of the turbine rotor blade 26 is greater than the local minimum value on both sides of the ridge 43, 45. That is, the squealer rib 40 (42, 44) has no flat surface forming the clearance 100 of the local minimum between the tip surface 35 of the turbine rotor blade 26 and the inner wall surface 23 of the casing 22, at both sides of the ridge 43, 44 of the squealer rib 40 (42, 44). Accordingly, there is no flat surface forming the clearance 100 of the local minimum at the downstream side of the ridge 43, 45, and thereby it is possible to suppress re-adhesion of a flow of a fluid to the squealer rib 40 (42, 44) when the flow of the fluid separates from the squealer rib 40 (42, 44) and passes through the ridge 43, 45. Thus, it is possible to suppress a decrease in the contraction-flow effect of the squealer rib 40 (42, 44) due to re-adhesion of a flow, and thus to reduce loss due to the leakage flow 102 (clearance loss) even further. Herein, the downstream side is the downstream side with respect to a flow direction of a gas passing through the gap between the tip surface 35 of the turbine rotor blade 26 and the inner wall surface 23 of the casing 22 (direction of a leakage flow).

For instance, if the squealer rib 40 (42, 44) has a flat face forming the clearance 100 of the local minimum that extends in the width direction, although a fluid flow has a velocity component directed outward in the radial direction when entering the clearance 100, the fluid flow is attracted to the flat face of the squealer rib 40 (42, 44) existing nearby when passing through the clearance 100, and flows parallel to the flat surface, which leads to reduction of the velocity component directed outward in the radial direction. Accordingly, the contraction-flow effect achieved by the squealer rib 40 (42, 44) deteriorates.

In this regard, with the above configuration, there is no flat face forming the clearance 100 of the local minimum that extends in the width direction on both sides of the ridge 43, 45, and thus the fluid flow does not get attracted to such a flat face to lose its velocity component directed outward in the radial direction, which makes it possible to maintain a high contraction-flow effect achieved by the squealer rib 40 (42, 44).

Furthermore, since the first squealer rib 42 and the second squealer rib 44 are disposed respectively on the sides of the pressure surface 31 and the suction surface 32, the effect to reduce the amount of leakage flow improves. In addition, since the squealer rib 40 (42, 44) has the ridge 43, 45, it is possible to achieve a remarkable effect to reduce the amount of leakage flow.

In some embodiments, the squealer rib 40 (42, 44) has a narrowing surface 53, 57 disposed between pressure-side edge 51, 55 on the side of the pressure surface 31 and the ridge 43, 45 disposed closer to the suction surface 32 than the pressure-side edge 51, 55, the narrowing surface 53, 57 monotonically reducing the clearance 100 from the pressure-side edge 51, 55 toward the ridge 43, 45.

Specifically, the squealer rib 40 (42, 44) has the pressure-side edge 51, 55 on the side closer to the pressure surface 31 than the ridge 43, 45, with respect to the width direction. For instance, the pressure-side edge 51 of the first squealer rib 42 is an edge portion (corner portion) on the boundary between the tip surface 35 and the side face on the outer periphery of the first squealer rib 42. In this case, the side face on the outer periphery of the first squealer rib 42 is flush with the pressure surface 31 of the airfoil portion 30. Furthermore, the pressure-side edge 55 of the second squealer rib 44 is an edge portion (corner portion) on the boundary between the tip surface 35 and the side face on the inner periphery of the second squealer rib 44. It should be noted that the configuration of the pressure-side edge 51, 55 is not limited to one disposed on a side face of the squealer rib 40 (42, 44).

Furthermore, the squealer rib 40 (42, 44) has the narrowing surface 53, 57 monotonically reducing the clearance 100 between the inner wall surface 23 of the casing 22 and the tip surface 35 of the turbine rotor blade 26, from the pressure-side edge 51, 55 toward the ridge 43, 45. For instance, the narrowing surface 53, 57 may be an inclined surface having a linear cross section as depicted in the drawing, or, although not depicted, a curved surface having a cross section with a curvature (curved surface bulging outward or inward in the radial direction).

Accordingly, with the narrowing surface 53, 57 monotonically reducing the clearance 100 from the pressure-side edge 51, 55 toward the ridge 43, 45, it is possible to form a fluid flow flowing outward in the radial direction along the narrowing surface 53, 57, and to enhance the contraction-flow effect.

In some embodiments, the squealer rib 40, which is at least one of the first squealer rib 42 or the second squealer rib 44, has a receding surface 54 disposed between a suction-side edge 52, 56 on the side of the suction surface 32 and the ridge 43, 45 disposed closer to the pressure surface 31 than the suction-side edge 52, 56, the receding surface 54 monotonically increasing the clearance 100 from the ridge 43, 45 toward the suction-side edge 52, 56.

In this case, the receding surface 54 monotonically increasing the clearance 100 between the tip surface 35 of the turbine rotor blade 26 and the inner wall surface 23 of the casing 22 toward the suction-side edge 52, 56 extends from the ridge 43, 45 to the suction-side edge 52, 56, and thereby re-adhesion of a fluid flow separated at the ridge 43, 45 to the receding surface 54 is even less likely to occur. Thus, it is possible to suppress effectively a decrease in the contraction-flow effect of the squealer rib 40 (42, 44) due to re-adhesion of a flow.

Specifically, the squealer rib 40 (42, 44) has the suction-side edge 52, 56 on the sides closer to the suction surface 32 than the ridge 43, 45, with respect to the width direction. For instance, the suction-side edge 52 of the first squealer rib 42 is an edge portion (corner portion) on the boundary between the tip surface 35 and the side face on the inner periphery of the first squealer rib 42. Furthermore, the suction-side edge 56 of the second squealer rib 44 is an edge portion (corner portion) on the boundary between the tip surface 35 and the side face on the outer periphery of the second squealer rib 44. In this case, the side face on the outer periphery of the second squealer rib 44 is flush with the suction surface 32 of the airfoil portion 30. It should be noted that the configuration of the suction-side edge 52, 56 is not limited to one disposed on the side face of the squealer rib 40 (42, 44).

Furthermore, the squealer rib 40 (42, 44) has the receding surface 54 monotonically increasing the clearance 100 between the inner wall surface 23 of the casing 22 and the tip surface 35 of the turbine rotor blade 26, from the suction-side edge 52, 56 toward the ridge 43, 45. For instance, the receding surface 54 may be an inclined surface having a linear cross section as depicted in the drawing, or, although not depicted, a curved surface having a cross section with a curvature (curved surface bulging outward or inward in the radial direction). While the first squealer rib 42 has the receding surface 54 in the examples depicted in FIGS. 6 and 8, the second squealer rib 44 may have a receding surface.

The above turbine rotor blade 26 may further have the following configuration.

In an embodiment, in a top view of the tip surface 35 of the turbine rotor blade 26, the normal of at least a part (at least a partial region along the extending direction of the squealer rib) of the narrowing surface 53, 57, or of the receding surface 54 of the squealer rib 40 (42, 44) is along the leakage flow 102.

Accordingly, the narrowing surface 53, 57, or the receding surface 54 directly faces the leakage flow 102 flowing toward the squealer rib 40 (42, 44), and thereby it is possible to reduce the amount of leakage flow effectively with the narrowing surface 53, 57, or the receding surface 54.

In another embodiment, in a top view of the tip surface 35 of the turbine rotor blade 26, the normal of at least a part of the narrowing surface 53, 57, or the receding surface 54 of the squealer rib 40 (42, 44) is in the same direction regardless of the position in the extending direction of the squealer rib.

In this case, the narrowing surface 53, 57 or the receding surface 54 of the squealer rib 40 (42, 44) can be readily processed.

Furthermore, in an embodiment, the outer surface of the squealer rib 40 (42, 44) may be treated with thermal barrier coating (TBC). In this case, TBC may be performed on the entire outer surface of the squealer rib 40 (42, 44), or on a part of the outer surface of the squealer rib 40 (42, 44), such as the narrowing surface 53, 57 or the receding surface 54.

Each of the embodiments depicted in FIGS. 4 to 8 will be described below.

Figure 4A:
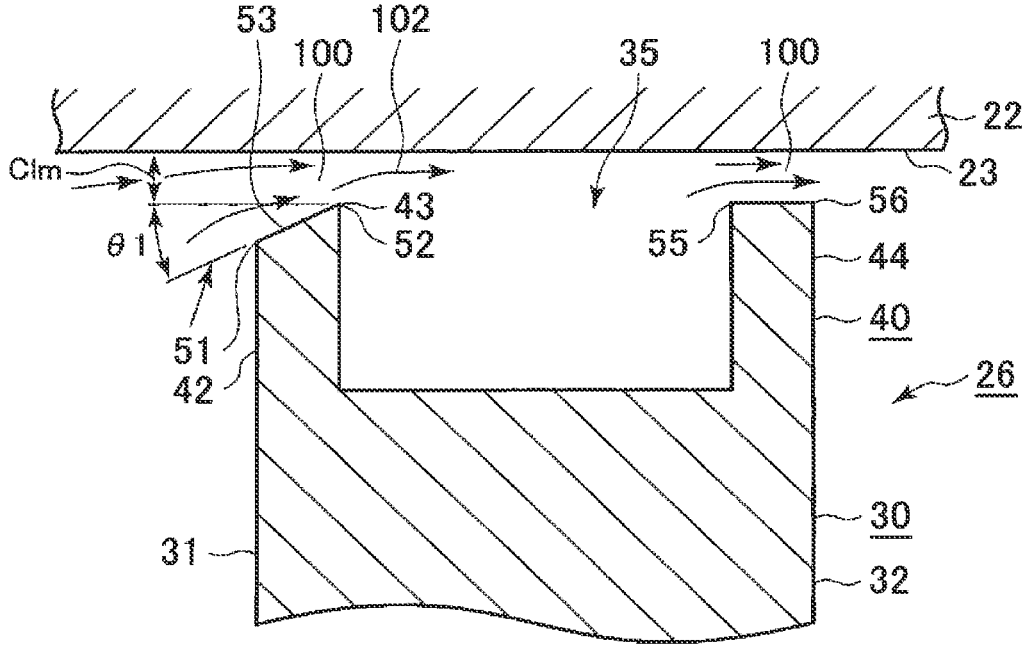
FIG. 4A is a cross-sectional view of a tip end of a turbine rotor blade and its peripheral structure according to an embodiment.
Figure 4B:
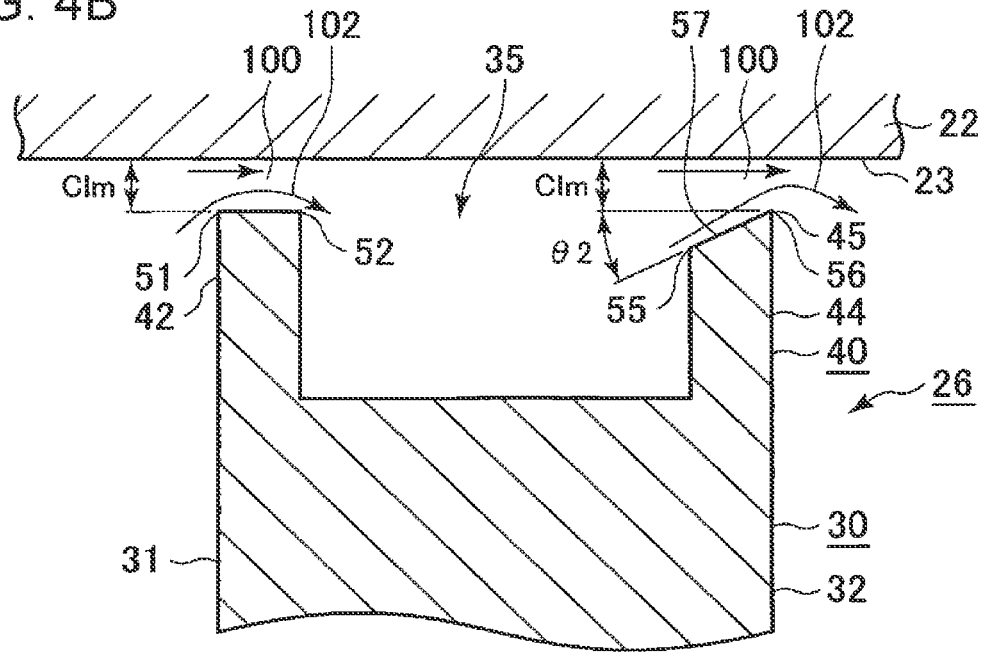
FIG. 4B is a cross-sectional view of a modified example of FIG. 4A.
Figure 4C:
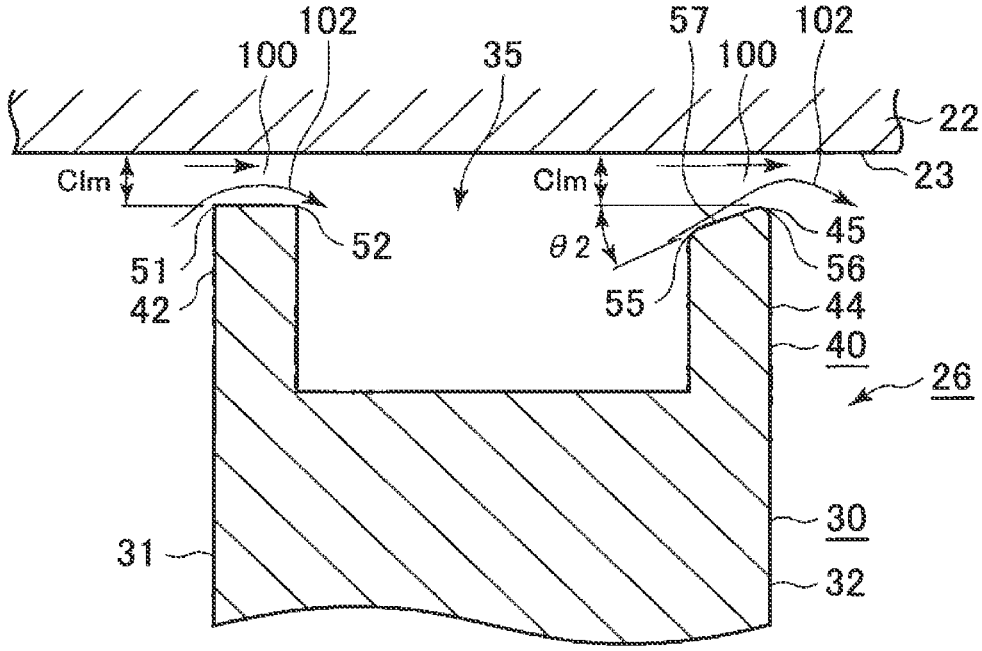
FIG. 4C is a cross-sectional view of another modified example of FIG. 4A.
Figure 5A:
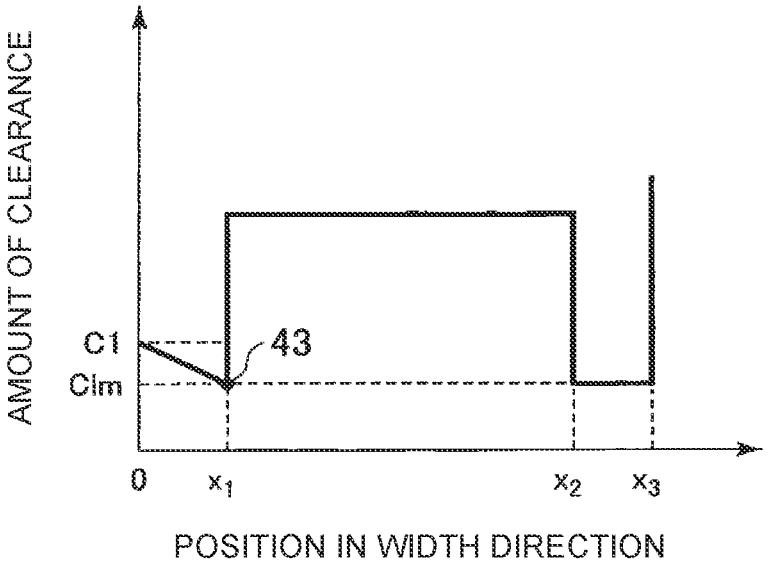
FIG. 5A is a diagram showing an amount of clearance in the width direction of a squealer rib, for the turbine rotor blade depicted in FIG. 4A.
Figure 5B:
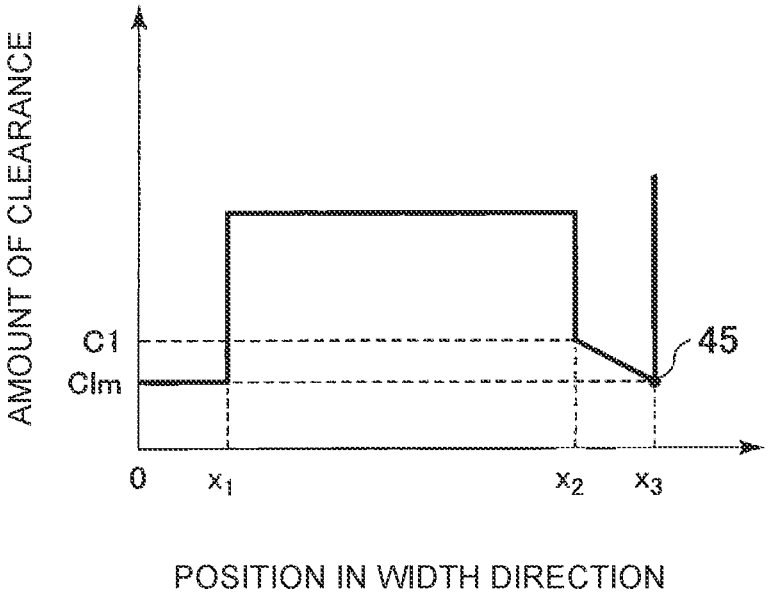
FIG. 5B is a diagram showing an amount of clearance in the width direction of a squealer rib, for the turbine rotor blade depicted in FIG. 4B.

FIG. 4A is a cross-sectional view of a tip end of the turbine rotor blade 26 and its peripheral structure according to an embodiment. FIG. 4B is a cross-sectional view of a modified example of FIG. 4A. FIG. 4C is a cross-sectional view of another modified example of FIG. 4A. FIG. 5A is a diagram showing an amount of clearance in the width direction of the squealer rib 40 (42, 44), for the turbine rotor blade 26 depicted in FIG. 4A. FIG. 5B is a diagram showing an amount of clearance in the width direction of the squealer rib 40 (42, 44), for the turbine rotor blade 26 depicted in FIG. 4B.

In the embodiment depicted in FIG. 4A, the first squealer rib 42 has a narrowing surface 53 disposed between the pressure-side edge 51 on the side of the pressure surface 31 and the ridge 43 disposed closer to the suction surface 32 than the pressure-side edge 51, the narrowing surface 57 monotonically reducing the clearance 100 from the pressure-side edge 51 toward the ridge 43. In the illustrated example, the suction-side edge 52 of the first squealer rib 42 coincides with the ridge 43. The second squealer rib 44 has neither a ridge nor a narrowing surface.

According to this embodiment, it is possible to achieve the contraction-flow effect at the first squealer rib 42 and the second squealer rib 44, as well as to form a fluid flow flowing outward in the radial direction along the narrowing surface 53 thanks to the first squealer rib 42 having the narrowing surface 53, which makes it possible to enhance the contraction-flow effect.

In the embodiment depicted in FIG. 4B, the second squealer rib 44 has a narrowing surface 57 disposed between the pressure-side edge 55 on the side of the pressure surface 31 and the ridge 45 disposed closer to the suction surface 32 than the pressure-side edge 55, the narrowing surface 57 monotonically reducing the clearance 100 from the pressure-side edge 55 toward the ridge 45. In the illustrated example, the suction-side edge 56 of the second squealer rib 44 coincides with the ridge 45. The first squealer rib 42 has neither a ridge nor a narrowing surface.

According to this embodiment, it is possible to achieve the contraction-flow effect at the first squealer rib 42 and the second squealer rib 44, as well as to form a fluid flow flowing outward in the radial direction along the narrowing surface 57 thanks to the second squealer rib 44 having the narrowing surface 57, which makes it possible to enhance the contraction-flow effect.

In the embodiment depicted in FIG. 4C, the second squealer rib 44 has a narrowing surface 57 disposed between the pressure-side edge 55 on the side of the pressure surface 31 and the ridge 45 disposed closer to the suction surface 32 than the pressure-side edge 55, the narrowing surface 53 monotonically reducing the clearance 100 from the pressure-side edge 55 toward the ridge 45. Furthermore, the second squealer rib 44 has an edge portion which includes the ridge 45 and which is chamfered. Moreover, another edge portion of the second squealer rib 44 not including the ridge 45 may also be chamfered, and the edge portions of the first squealer rib 42 may also be chamfered.

Accordingly, it is possible to reduce oxidation thinning of the edge portions of the first squealer rib 42 or the second squealer rib 44, and to improve the reliability of the turbine rotor blade 26.

The graphs depicted in FIGS. 5A and 5B show the amount of clearance in the width direction of the squealer rib 40 (42, 44), provided that the zero position is the position of the pressure surface 31, specifically the position of the pressure-side edge 51 of the first squealer rib 42, $x_1$ is the position of the suction-side edge 52 of the first squealer rib 42, $x_2$ is the position of the pressure-side edge 55 of the second squealer rib 44, and $x_3$ is the position of the suction-side edge 56 of the second squealer rib 44.

FIG. 5A shows the amount of clearance for the turbine rotor blade 26 having the ridge 43 on the suction-side edge 52 of the first squealer rib 42 (see FIG. 4A), and the amount of clearance between the tip surface 35 of the turbine rotor blade 26 and the inner wall surface 23 of the casing 22 is the local minimum value $C_{lm}$, at the position $x_1$ of the ridge 43. FIG. 5B shows the amount of clearance for the turbine rotor blade 26 having the ridge 45 on the suction-side edge 56 of the second squealer rib 44 (see FIG. 4B), and the amount of clearance between the tip surface 35 of the turbine rotor blade 26 and the inner wall surface 23 of the casing 22 is the local minimum value $C_{lm}$, at the position $x_3$ of the ridge 45. $C_1$ is the amount of clearance at the farthest position from the inner wall surface 23 of the casing 22, in the range of the narrowing surface 53, 57 including the ridge 43, 45.

Herein, in the present specification, the local minimum value $C_{lm}$ is the amount of clearance $C(x_1)$, when the amount of clearance $C(x_1)$ at the position $x_1$ (or $x_3$) and the amount of clearance $C(x)$ at a position in the vicinity of the position $x_1$ (or $x_3$) satisfy a relationship $C(x)>C(x_1)$. Thus, as depicted in FIG. 7C for instance, even if the amount of clearance at the position of the ridge 43 of the first squealer rib 42 is larger than the amount of clearance at the position of the ridge 45 of the second squealer rib 44, the clearance 100 has the above defined local minimum value at each of the positions of the ridges 43, 45, and thus it is possible to enhance the contraction-flow effect at both of the ridges 43, 45.

Figure 6:
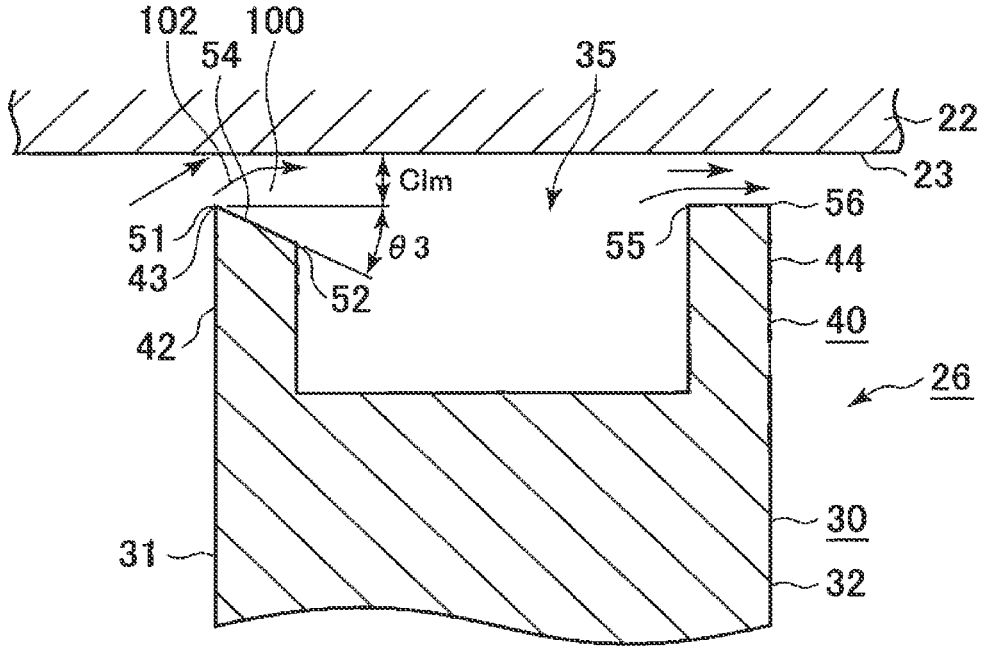
FIG. 6 is a cross-sectional view of a tip end of a turbine rotor blade and its peripheral structure according to another embodiment.

FIG. 6 is a cross-sectional view of a tip end of a turbine rotor blade and its peripheral structure according to another embodiment.

In the embodiment depicted in FIG. 6, the first squealer rib 42 has a receding surface 54 disposed between the suction-side edge 52 on the side of the suction surface 32 and the ridge 43 disposed closer to the pressure surface 31 than the suction-side edge 52, the receding surface 54 monotonically increasing the clearance 100 from the ridge 43 toward the suction-side edge 52. The second squealer rib 44 has neither a ridge nor a narrowing surface.

According to this embodiment, it is possible to achieve the contraction-flow effect at the first squealer rib 42 and the second squealer rib 44, and the first squealer rib 42 has the receding surface 54, which further reduces the risk of re-adhesion of a fluid flow separated at the ridge 43 to the receding surface 54. Thus, it is possible to suppress effectively a decrease in the contraction-flow effect due to re-adhesion of a flow.

Figure 7A:
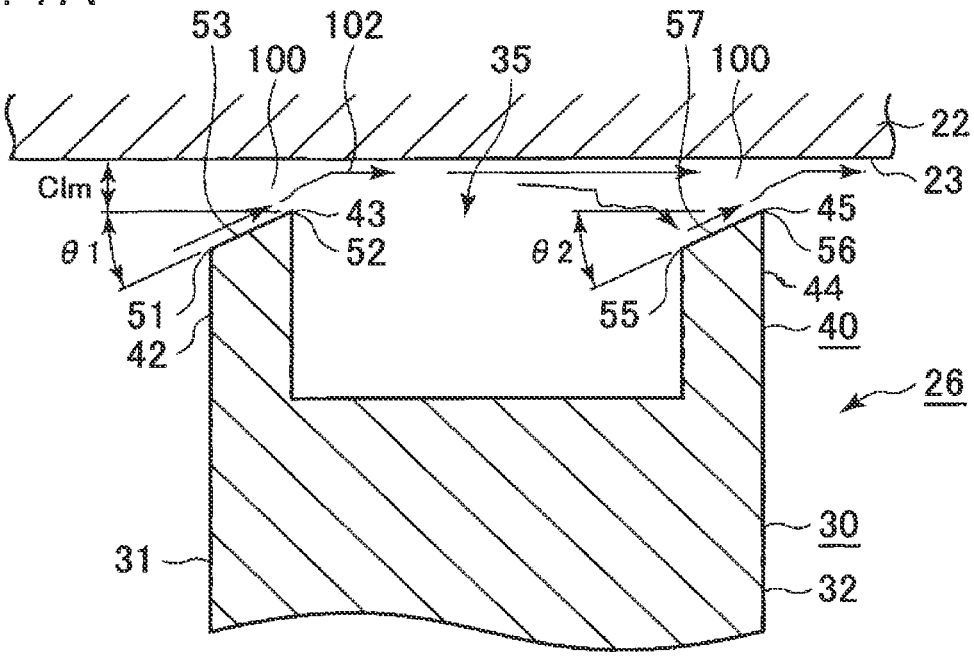
FIG. 7A is a cross-sectional view of a tip end of a turbine rotor blade and its peripheral structure according to another embodiment.
Figure 7B:
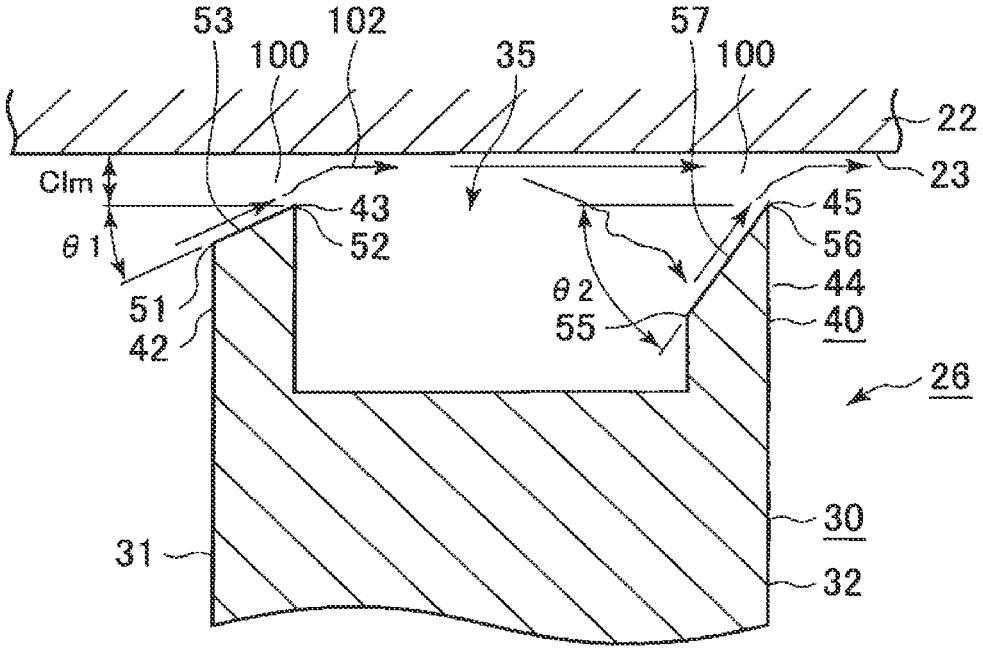
FIG. 7B is a cross-sectional view of a modified example of FIG. 7A.
Figure 7C:
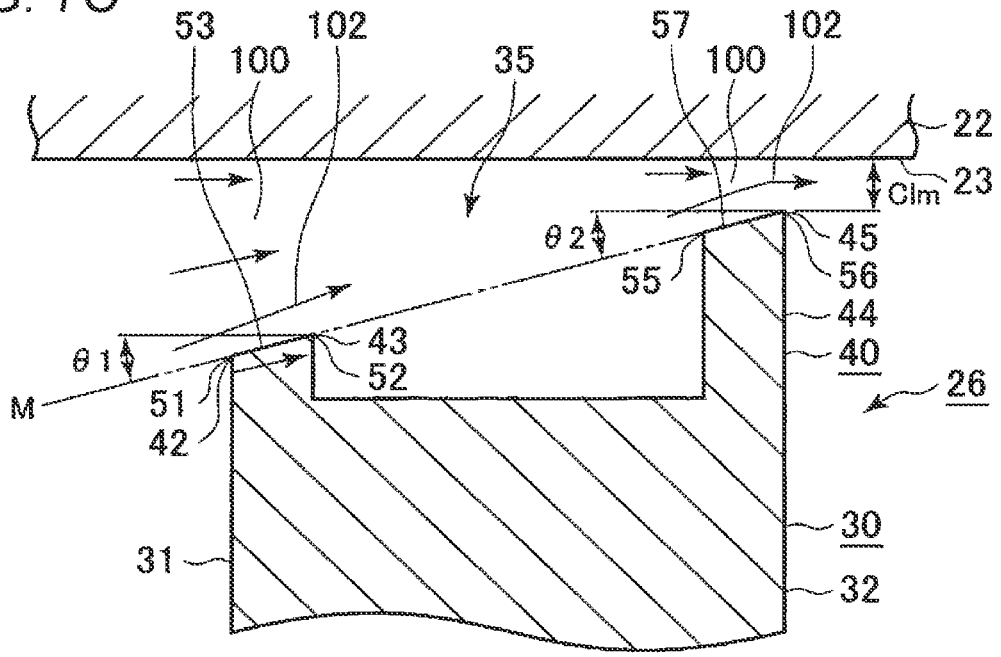
FIG. 7C is a cross-sectional view of another modified example of FIG. 7A.

In the embodiments depicted in FIGS. 7A to 7C, the first squealer rib 42 and the second squealer rib 44 have narrowing surfaces 53, 57, respectively, disposed between pressure-side edges 51, 55 on the side of the pressure surface 31 and the ridges 43, 45 disposed closer to the suction surface 32 than the pressure-side edges 51, 55, the narrowing surfaces 53, 57 monotonically reducing the clearance 100 from the pressure-side edges 51, 55 toward the ridges 43, 45.

According to the above embodiment, the first contraction-flow effect is achieved by the first squealer rib 42. The first contraction flow along the narrowing surface 53 of the first squealer rib 42 diffuses at the downstream side of the ridge 43 of the first squealer rib 42, but at least a part of the diffused flow is captured by the narrowing surface 57 of the second squealer rib 44, and thereby the second contraction-flow effect is achieved by the narrowing surface 57 of the second squealer rib 44. Accordingly, it is possible to reduce the amount of leakage flow effectively with the first squealer rib 42 and the second squealer rib 44.

According to the embodiment depicted in FIG. 7A, in the width direction of the squealer rib 40, the amount of clearance is the same at the position of the ridge 43 of the first squealer rib 42 and at the position of the ridge 45 of the second squealer rib 44. Specifically, the amount of clearance is the local minimum value $C_{lm}$.

Furthermore, the angle $\theta_1$ formed by the narrowing surface 53 of the first squealer rib 42 with the inner wall surface 23 of the casing 22 is the same as the angle $\theta_2$ formed by the narrowing surface 57 of the second squealer rib 44 with the inner wall surface 23 of the casing 22.

In a modified example depicted in FIG. 7B, the narrowing surface 57 of the second squealer rib 44 is disposed over a wider range in the blade-height direction of the turbine rotor blade 26 than the narrowing surface 53 of the first squealer rib 42.

Accordingly, the flow diffused at the downstream side of the ridge 43 of the first squealer rib 42 can be captured in the wider range at the narrowing surface 57 of the second squealer rib 44, which makes it possible to enhance the contraction-flow effect achieved by the second squealer rib 44.

In this case, the narrowing surface 53 of the first squealer rib 42 and the narrowing surface 57 of the second squealer rib 44 may be inclined from the inner wall surface 23 of the casing 22, and the angle $\theta_2$ formed by the narrowing surface 57 of the second squealer rib 44 with the inner wall surface 23 of the casing 22 may be greater than the angle $\theta_1$ formed by the narrowing surface 53 of the first squealer rib 42 with the inner wall surface 23 of the casing 22.

Accordingly, as compared to a case in which the narrowing surface 53 of the first squealer rib 42 and the narrowing surface 57 of the second squealer rib 44 are inclined from the inner wall surface 23 of the casing 22 at the same angle, the fluid flowing along the narrowing surface 57 of the second squealer rib 44 has a stronger velocity component directed outward in the radial direction, which makes it possible to enhance the contraction-flow effect achieved by the second squealer rib 44. At the second squealer rib 44 disposed closer to the suction surface 32, the temperature is reduced due to mixing of high-temperature combustion gas and cooling air, and thus the risk of oxidation thinning is small around the ridge 43 of the second squealer rib 44 even if the angle $\theta_2$ formed by the narrowing surface 57 of the second squealer rib 44 is increased.

In another modified example depicted in FIG. 7C, the narrowing surface 53 of the first squealer rib 42 and the narrowing surface 57 of the second squealer rib 44 are inclined from the inner wall surface 23 of the casing 22 to form angles $\theta_1$ and $\theta_2$, respectively. Furthermore, the narrowing surface 57 of the second squealer rib 44 is on the same plane M as the narrowing surface 53 of the first squealer rib 42. Specifically, the angle $\theta_1$ of the narrowing surface 53 of the first squealer rib 42 is the same as the angle $\theta_2$ of the narrowing surface 57 of the second squealer rib 44, and the position of the narrowing surface 53 of the first squealer rib 42 in the blade-height direction is lower than the position of the narrowing surface 57 of the second squealer rib 44 in the blade-height direction (i.e., the narrowing surface 53 of the first squealer rib 42 is farther away from the inner wall surface 23 than the narrowing surface 57 of the second squealer rib 44), so that the narrowing surface 53 and the narrowing surface 57 are on the same plane M.

Accordingly, it is possible to send a flow having a velocity component directed outward in the radial direction enhanced at the narrowing surface 53 of the first squealer rib 42 to the narrowing surface 57 of the second squealer rib 44 disposed on the same plane M as the narrowing surface 53 of the first squealer rib 42, which makes it possible to improve the contraction-flow effect at the second squealer rib 44.

Figure 8:
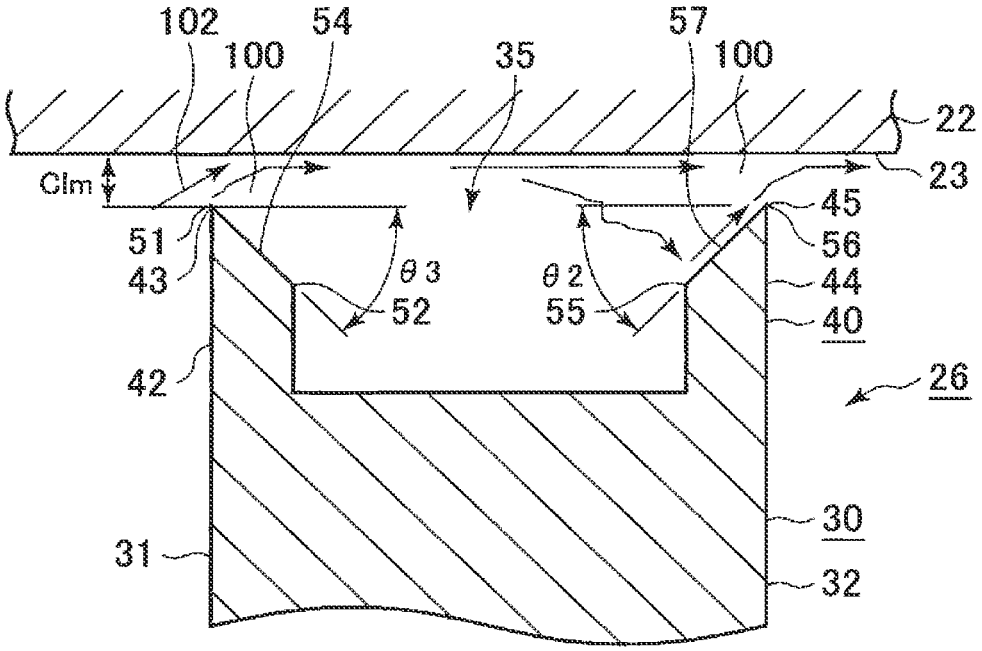
FIG. 8 is a cross-sectional view of a tip end of a turbine rotor blade and its peripheral structure according to another embodiment.

FIG. 8 is a cross-sectional view of a tip end of the turbine rotor blade 26 and its peripheral structure according to another embodiment.

In the embodiment depicted in FIG. 8, the first squealer rib 42 has a receding surface 54 disposed between the suction-side edge 52 on the side of the suction surface 32 and the ridge 43 disposed closer to the pressure surface 31 than the suction-side edge 52, the receding surface 54 monotonically increasing the clearance 100 from the ridge 43 toward the suction-side edge 52. Furthermore, the second squealer rib 44 has the narrowing surface 57 disposed between the pressure-side edge 55 on the side of the pressure surface 31 and the ridge 45 disposed closer to the suction surface 32 than the pressure-side edge 55, the narrowing surface 53 monotonically reducing the clearance 100 from the pressure-side edge 55 toward the ridge 45. Specifically, the receding surface 54 of the first squealer rib 42 and the narrowing surface 57 of the second squealer rib 44 are disposed so as to face each other at an angle. In this case, the angle $\theta_3$ formed by the receding surface 54 of the first squealer rib 42 with the inner wall surface 23 of the casing 22 may be the same as, or different from, the angle $\theta_2$ formed by the narrowing surface 57 of the second squealer rib 44 with the inner wall surface 23 of the casing 22.

According to the above embodiment, it is possible to suppress re-adhesion of a fluid to the first squealer rib 42 at the downstream side of the ridge 43 at the first squealer rib 42, and thus to enhance the contraction-flow effect achieved by the first squealer rib 42. Furthermore, a flow having passed through the first squealer rib 42 diffuses at the downstream side of the ridge 43, but at least a part of the diffused flow is captured by the narrowing surface 57 of the second squealer rib 44, and thereby the second contraction-flow effect is achieved by the narrowing surface 57 of the second squealer rib 44.

Further, the narrowing surface 57 of the second squealer rib 44 may be disposed over a wider range in the blade-height direction of the turbine rotor blade 26 than the receding surface 54 of the first squealer rib 42.

Accordingly, the flow diffused at the downstream side of the ridge 43 of the first squealer rib 42 can be captured in the wider range at the narrowing surface 57 of the second squealer rib 44, which makes it possible to enhance the contraction-flow effect achieved by the second squealer rib 44.

Furthermore, the receding surface 54 of the first squealer rib 42 and the narrowing surface 57 of the second squealer rib 44 are inclined from the inner wall surface 23 of the casing 22, and the narrowing surface 57 of the second squealer rib 44 may have an inclination angle of a greater absolute value than the receding surface 54 of the first squealer rib 42, with respect to the inner wall surface 23 of the casing 22. Specifically, the angle $\theta_2$ of the narrowing surface 57 of the second squealer rib 44 may be larger than the angle $\theta_3$ of the receding surface 54 of the first squealer rib 42.

Accordingly, it is possible to enhance the velocity component, directed outward in the radial direction, of the fluid flowing along the narrowing surface 57 of the second squealer rib 44, and to improve the contraction-flow effect achieved by the second squealer rib 44. At the second squealer rib 44 disposed closer to the suction surface 32, the temperature is reduced due to mixing of high-temperature combustion gas and cooling air, and thus the risk of oxidation thinning is small around the ridge 43 of the second squealer rib 44 even if the inclination angle ($\theta_2$) formed by the narrowing surface 57 of the second squealer rib 44 is increased.

Figure 9A:
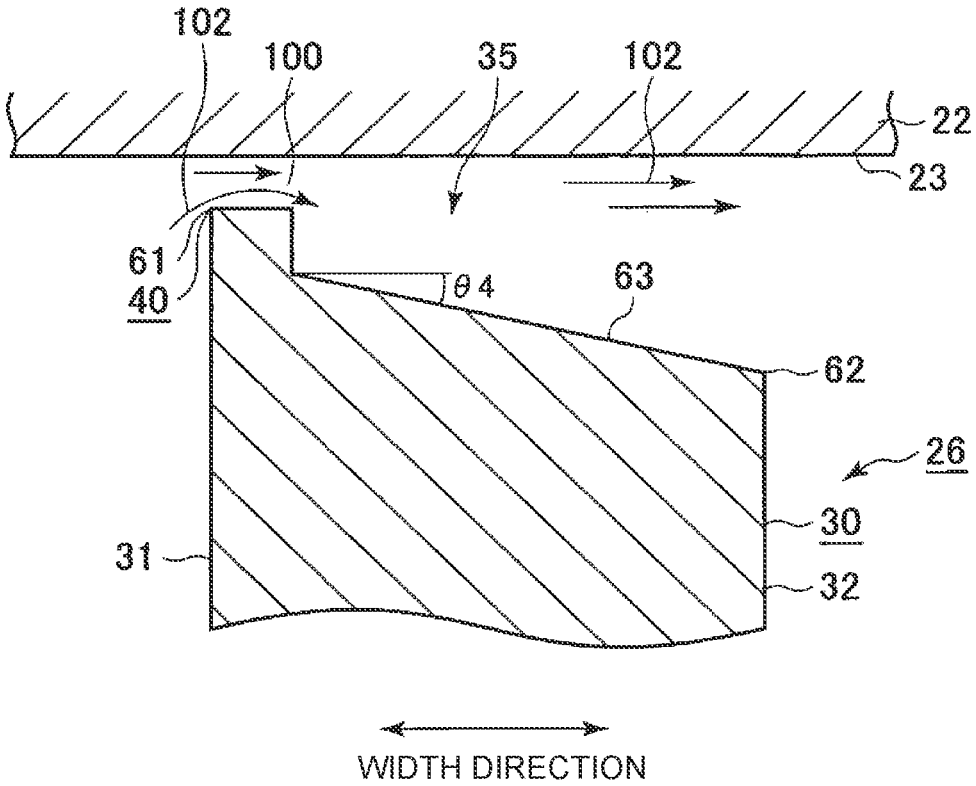
FIG. 9A is a cross-sectional view of a tip end of a turbine rotor blade and its peripheral structure according to another embodiment.
Figure 9B:
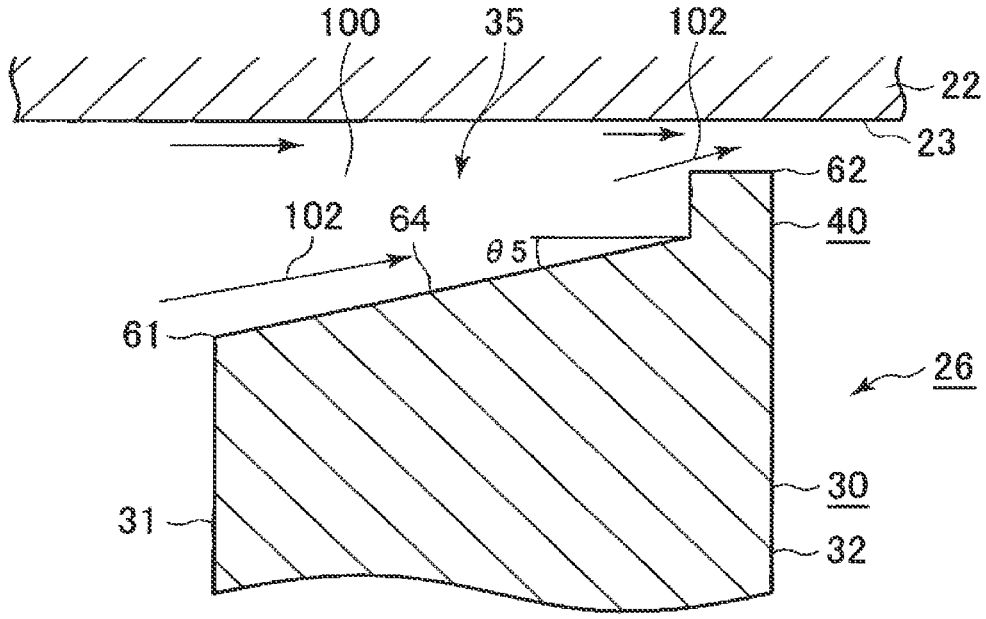
FIG. 9B is a cross-sectional view of a modified example of FIG. 9A.

The turbine rotor blade 26 may include the configuration depicted in FIG. 9, as an embodiment different from the above-described embodiments depicted in the FIGS. 4 to 8. It goes without saying that the turbine rotor blade 26 may include a configuration combining at least one of the embodiments depicted in FIGS. 4 to 8 and the embodiment depicted in FIG. 9. FIG. 9A is a cross-sectional view of a tip end of a turbine rotor blade and its peripheral structure according to another embodiment. FIG. 9B is a cross-sectional view of a modified example of FIG. 9A.

In the embodiment depicted in FIG. 9A, the turbine rotor blade 26 includes at least one squealer rib 40 disposed on an edge portion 61 on the side of the pressure surface 31 on the tip surface 35 of the turbine rotor blade 26, extending from the leading edge 33 toward the trailing edge 34. An inclined surface 63 is formed in a region of the tip surface 35 other than the squealer rib 40, and is inclined from the inner wall surface 23 of the casing 22 facing the tip surface 35. Furthermore, the inclined surface 63 is inclined so that the clearance 100 between the tip surface 35 and the inner wall surface 23 of the casing 22 widens with a distance from the squealer rib 40, in the width direction of the squealer rib 40.

Accordingly, it is possible to suppress re-adhesion of a flow toward the inclined surface (region other than the squealer rib on the tip surface of the turbine rotor blade 26) disposed closer to the suction surface 32 than the squealer rib 40, at the downstream side of the squealer rib 40. Thus, it is possible to suppress a decrease in the contraction-flow effect of the squealer rib 40 due to re-adhesion of a flow, and to reduce loss due to the leakage flow 102 (clearance loss).

In the embodiment depicted in FIG. 9B, the turbine rotor blade 26 includes a squealer rib 40 disposed on an edge portion 62 on the side of the suction surface 32 on the tip surface 35 of the turbine rotor blade 26, extending from the leading edge 33 toward the trailing edge 34. An inclined surface 64 is formed in a region of the tip surface 35 other than the squealer rib 40, and is inclined from the inner wall surface 23 of the casing 22 facing the tip surface 35. Furthermore, the inclined surface 64 is inclined so that the clearance between the tip surface 35 and the inner wall surface 23 of the casing 22 widens with a distance from the squealer rib 40, in the width direction of the squealer rib 40.

Accordingly, the inclined surface (region other than the squealer rib on the tip surface of the turbine rotor blade 26) disposed closer to the pressure surface 31 than the squealer rib 40 forms a fluid flow directed outward in the radial direction, and thereby the contraction-flow effect at the squealer rib 40 is enhanced. Thus, it is possible to reduce the amount of leakage flow by the high contraction-flow effect achieved by the squealer rib 40, and to reduce loss due to the leakage flow 102 (clearance loss).

In some embodiments, the turbine rotor blade 26 depicted in any one of FIGS. 4 to 9 is applied to the gas turbine 1 (see FIG. 1).

With the turbine rotor blade 26 according to the above embodiments, it is possible to reduce loss (clearance loss) due to the leakage flow 102 through the clearance 100 between the tip surface 35 of the turbine rotor blade 26 and the inner wall surface 23 of the casing 22, and thus it is possible to improve efficiency of the gas turbine 1 to which the turbine rotor blade 26 is applied.

In some embodiments, the gas turbine 1 depicted in FIG. 1 includes a turbine rotor blade 26 depicted in any one of FIGS. 4 to 9. Specifically, as depicted in FIG. 1, the gas turbine 1 includes a turbine 6 including a rotor shaft 8 to which a plurality of above-mentioned turbine rotor blades 26 are mounted in the circumferential direction, and a casing (turbine casing) 22 housing the rotor shaft 8, a combustor 4 formed inside the casing 22 to supply a combustion-gas passage accommodating the turbine rotor blades 26 with combustion gas, and a compressor 2 configured to be driven by the turbine 6 to produce compressed air to be supplied to the combustor 4.

With the turbine rotor blade 26 according to the above embodiments, it is possible to reduce loss (clearance loss) due to the leakage flow 102 through the clearance 100 between the tip surface 35 of the turbine rotor blade 26 and the inner wall surface 23 of the casing 22, and thus it is possible to improve efficiency of the gas turbine 1.

As described above, according to the embodiments of the present invention, it is possible to maintain a high contraction-flow effect achieved by at least one squealer rib 40 (42, 44) disposed on the turbine rotor blade 26. Thus, it is possible to reduce the amount of leakage flow at the clearance 100 between the tip surface 35 of the turbine rotor blade 26 and the inner wall surface 23 of the casing 22, and to reduce loss (clearance loss) due to the leakage flow 102.

Embodiments of the present invention were described in detail above, but the present invention is not limited thereto, and various amendments and modifications may be implemented.

For instance, while the ridge 43, 45 of the squealer rib 40 (42, 44) is disposed on a side face of the squealer rib 40, the position of the ridge 43, 45 is not limited to this. For instance, the ridge 43, 45 may be provided in the center region of the squealer rib 40 (42, 44) in the width direction, with a narrowing surface and a receding surface provided on either side of the ridge 43, 45, while the ridge 43, 45 is positioned in the center. In this case, the squealer rib 40 (42, 44) has a mound shape in a cross section (cross section taken along line Y-Y in FIG. 2), in which the ridge 43, 45 in the center region protrudes outward in the radial direction.

Alternatively, while each squealer rib 40 (42, 44) has only one of the ridges 43, 45 and the tip surface 35 has one inclined surface comprising a narrowing surface or a receding surface in the above embodiments, the configuration of the tip surface 35 is not limited to this. For instance, the tip surface 35 may be provided with a stepped portion, or one squealer rib 40 (42, 44) may be provided with a plurality of ridges.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

DESCRIPTION OF REFERENCE NUMERALS

1 Gas turbine
2 Compressor
4 Combustor
6 Turbine
8 Rotor shaft
10 Compressor casing
16 Compressor stator vane
18 Compressor rotor blade
20 Casing (combustor casing)
22 Casing (Turbine casing)
23 Inner wall surface
24 Turbine stator vane
26 Turbine rotor blade
28 Exhaust casing
30 Airfoil portion
31 Pressure surface
32 Suction surface
33 Leading edge
34 Trailing edge
35 Tip surface
40 Squealer rib
42 First squealer rib
43, 45 Ridge
44 Second squealer rib
51, 55 Pressure-side edge
52, 56 Suction-side edge
53, 57 Narrowing surface
54 Receding surface
61, 62 Edge portion
63, 64 Inclined surface
100 Clearance
102 Leakage flow

The invention claimed is:

1. A turbine rotor blade for a turbine, the turbine rotor blade comprising:

an airfoil portion having an airfoil defined by a pressure surface and a suction surface; and a squealer rib on a tip surface of the turbine rotor blade, the squealer rib extending from a leading-edge side of the turbine rotor blade toward a trailing-edge side of the turbine rotor blade, wherein the squealer rib has a ridge extending in an extending direction of the squealer rib, wherein the tip surface of the turbine rotor blade is configured to face an inner wall surface of a casing of the turbine, wherein the turbine rotor blade is configured to provide a clearance between the tip surface of the turbine rotor blade and the inner wall surface of the casing of the turbine such that the clearance has a local minimum value on the ridge, wherein the clearance is greater than the local minimum value at an axially inner side of the ridge in a width direction of the squealer rib, wherein the squealer rib has a narrowing surface between the ridge and a pressure-side edge of the squealer rib on a pressure side of the squealer rib, wherein the ridge is at an intersection between the narrowing surface and the suction surface of the airfoil portion, and wherein a slope of the narrowing surface is constant over an entire length of the narrowing surface from the pressure-side edge of the squealer rib toward the ridge such that the narrowing surface is configured to monotonically reduce the clearance from the pressure-side edge of the squealer rib toward the ridge.

2. The turbine rotor blade according to claim 1, wherein the squealer rib is a first squealer rib, the ridge is a first ridge, the clearance is a first clearance, the local minimum value is a first local minimum value, and the turbine rotor blade further comprises a second squealer rib, wherein the second squealer rib has a second ridge extending in an extending direction of the second squealer rib, wherein the turbine rotor blade is configured to provide a second clearance between the tip surface of the turbine rotor blade and the inner wall surface of the casing of the turbine such that the second clearance has a second local minimum value on the second ridge, wherein the second squealer rib has a receding surface between the second ridge and a suction-side edge of the second squealer rib on a suction side of the second squealer rib, wherein the second ridge is closer to a pressure side of the second squealer rib than the suction-side edge of the second squealer rib, wherein the second ridge is at an intersection between the receding surface and the pressure surface of the airfoil portion, and wherein a slope of the receding surface is constant over an entire length of the receding surface from the suction-side edge of the second squealer rib toward the second ridge such that the receding surface is configured to monotonically increase the second clearance from the second ridge toward the suction-side edge of the second squealer rib.

3. The turbine rotor blade according to claim 1, wherein the squealer rib is a first squealer rib and the turbine rotor blade further comprises a second squealer rib, wherein the first squealer rib is disposed on a suction side of the turbine rotor blade, wherein the second squealer rib is disposed on a pressure side of the turbine rotor blade, and wherein the second squealer rib is disposed at a distance from the first squealer rib.

4. The turbine rotor blade according to claim 3, wherein the ridge is a first ridge, the clearance is a first clearance, the local minimum value is a first local minimum value, and the narrowing surface is a first narrowing surface, wherein the second squealer rib has a second ridge extending in an extending direction of the second squealer rib, wherein the turbine rotor blade is configured to provide a second clearance between the tip surface of the turbine rotor blade and the inner wall surface of the casing of the turbine such that the second clearance has a second local minimum value on the second ridge, wherein the second squealer rib has a second narrowing surface between the second ridge and a pressure-side edge of the second squealer rib on a pressure side of the second squealer rib, wherein the second ridge is closer to a suction side of the second squealer rib than the pressure-side edge of the second squealer rib, wherein the second ridge is at an intersection between the second narrowing surface and the suction side of the second squealer rib, and wherein a slope of the second narrowing surface is constant over an entire length of the second narrowing surface from the pressure-side edge of the second squealer rib toward the second ridge such that the second narrowing surface is configured to monotonically reduce the second clearance from the second ridge toward the pressure-side edge of the second squealer rib.

5. The turbine rotor blade according to claim 4, wherein the first narrowing surface is disposed over a wider range in a blade height direction of the turbine rotor blade than the second narrowing surface.

6. The turbine rotor blade according to claim 5, wherein the first narrowing surface and the second narrowing surface are configured to be inclined from the inner wall surface of the casing of the turbine, and wherein the first narrowing surface has a greater inclination angle than the second narrowing surface with respect to the inner wall surface of the casing of the turbine.

7. The turbine rotor blade according to claim 4, wherein the first narrowing surface and the second narrowing surface are configured to be inclined from the inner wall surface of the casing of the turbine, and wherein the first narrowing surface is on a same plane as the second narrowing surface.

8. The turbine rotor blade according to claim 1, wherein the squealer rib has a chamfered edge portion including the ridge.

9. The turbine rotor blade according to claim 1, wherein the turbine is a gas turbine.

10. A gas turbine, comprising:

a turbine including a rotor shaft having the turbine rotor blade according to claim 9 mounted to the rotor shaft in a circumferential direction, and a turbine casing housing the rotor shaft;

a combustor for supplying combustion gas to a combustion gas passage accommodating the turbine rotor blade; and a compressor configured to be driven by the turbine and produce compressed air to be supplied to the combustor, wherein the combustor is inside the turbine casing.

11. The turbine rotor blade according to claim 1, wherein the squealer rib is disposed at least partially along an outer periphery of the airfoil portion on the tip surface of the turbine rotor blade.

12. The turbine rotor blade according to claim 3, wherein the first local minimum value is equal to the second local minimum value.

* * * * *